United States Patent [19]

Luthi et al.

[11] Patent Number: 4,770,604

[45] Date of Patent: Sep. 13, 1988

[54] PULP CENTRIFUGAL PUMP

[75] Inventors: Oscar Luthi, Nashua; Donald B. Johnson, Litchfield, both of N.H.

[73] Assignee: Ingersoll-Rand Company, Woodcliff Lake, N.J.

[21] Appl. No.: 915,175

[22] Filed: Oct. 6, 1986

[51] Int. Cl.[4] ..... F04D 1/06; F04D 7/00

[52] U.S. Cl. ..... 415/62; 415/68; 415/121 R; 415/143; 415/168; 416/188

[58] Field of Search ..... 415/60, 62, 66, 68, 415/73, 74, 121 R, 121 A, 121 B, 143, 168, 215, 199.6; 416/188, 176, 186 R

[56] References Cited

U.S. PATENT DOCUMENTS

| | | | |
|---|---|---|---|
| 718,557 | 1/1903 | Wenzel | 415/199.6 |
| 2,975,714 | 3/1961 | Nechine | 415/74 X |
| 3,164,330 | 1/1965 | Neidl | 415/121 B X |
| 3,257,782 | 6/1966 | Weiss | 415/168 X |
| 3,692,422 | 9/1972 | Girardier | 415/215 X |
| 3,918,852 | 11/1975 | Carter | 415/66 X |

FOREIGN PATENT DOCUMENTS

| | | | |
|---|---|---|---|
| 724801 | 3/1980 | U.S.S.R. | 415/143 |
| 731058 | 4/1980 | U.S.S.R. | 415/143 |
| 866285 | 9/1981 | U.S.S.R. | 415/121 B |

*Primary Examiner*—Robert E. Garrett
*Assistant Examiner*—Joseph M. Pitko
*Attorney, Agent, or Firm*—Frank S. Troidl

[57] ABSTRACT

A pulp feeder feeds the pulp from the pulp feeder housing to the pump impeller. The impeller is provided with vanes specially constructed to provide channels of sufficient dimension to permit the flow of the pulp through the channels. The impeller also has helical flights for feeding the pulp to the channels. The end of the pulp feeder is spaced close enough to the impeller to feed the pulp to the impeller flights but far enough away from the impeller to not interfere with the removal of air. An air removal pipe may also be included in the pulp feeder housing.

6 Claims, 2 Drawing Sheets

PULP CENTRIFUGAL PUMP

This invention relates to the pulp and paper industry. More particularly, this invention is a new centrifugal pump for pumping pulp.

It is not easy to pump pulp such as wood pulp. The wood fibers tend to adhere to one another and form flocks. This property causes the pulp to have high internal friction. The higher the consistency of the pulp the more the internal friction. The "consistency" is defined as the percentage, by weight, of dry, fibrous material in any combination of pulp and liquid.

Pumps used to pump materials other than pulp are not suitable for pumping pulp. For example, pulp has unique fluid properties which are quite different from the fluid properties of water. The natural tendency of the fibers to stick together will prevent eddy currents or turbulent flow. Rapid changes in the pulp flow cross-sections must be avoided because the internal friction resists the deformation of the pulp stream. Convergent cross-sections will cause plugging. Divergent cross-sections will cause separation. Sudden changes in the direction of the pulp flow must also be avoided. The flow must be at more than a predetermined velocity. Low velocity pockets will cause plugging and stop the flow altogether because of the internal friction. These flow properties are just some of the many pulp properties which must be considered in the construction of a pulp centrifugal pump.

Briefly described, this invention comprises a pulp housing with a pulp feeder in the housing. A pump housing has a pulp inlet generally aligned with the pulp feeder for receiving the pulp from the pulp feeder. An impeller is provided in the pump housing for feeding the pulp from the pulp inlet to a pulp outlet which extends along a plane generally transversely to the axis of the pulp inlet. The impeller has a predetermined number of vanes. The vanes are constructed to form channels for receiving the pulp and pumping the pulp to the pulp outlet. Each channel has substantially the same volume and each channel has a minimum of changes in flow cross-sections and a minimum of changes in direction as the pulp flows through the channels. The impeller also has helical flights for feeding the pulp to the channels, one flight for each channel. A longitudinal space is provided between the impeller and the end of the pulp feeder facing the impeller. The length of the space is predetermined so that air which is separated from the pulp by centrifugal force caused by rotation of the impeller flights is circulated back into said space and moved through the impeller.

Air may be removed from the pulp feeder housing by providing a tube extending through the shaft of the pulp feeder. A vacuum pump attached to the tube is used for air removal.

The invention, as well as its many advantages, may be further understood by reference to the following detailed description and drawings in which.

In the various figures, like parts are referred to by like numbers.

Figure 1:
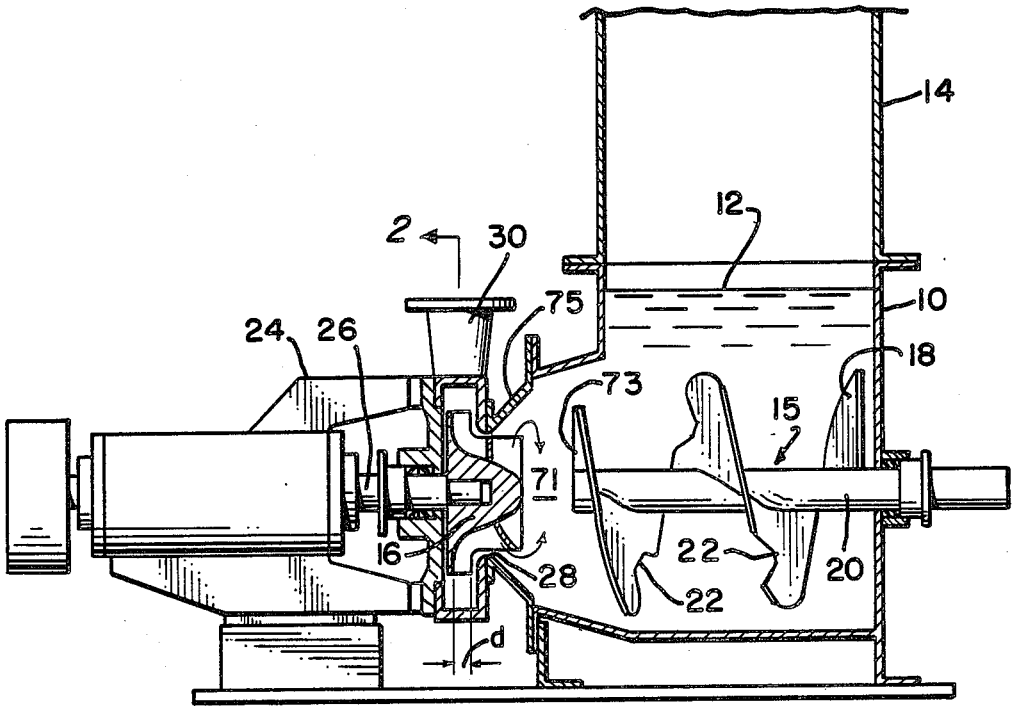
FIG. 1 is a side view, partly in section, of a preferred embodiment of the invention.

Referring to the drawings and more particularly to Fig. 1, the pulp centrifugal pump includes a pulp feeder housing 10 in which is maintained a pulp level 12 to provide the inlet head. Pulp is fed to the pulp feeder housing 10 by means of pulp conduit 14.

A rotatable screw pulp feeder 15 is located in the pulp feeder housing 10 for feeding the pulp from the pulp feeder housing 10 to the pump impeller 16. The screw feeder is provided with a screw flight 18 which is mounted on the rotatable shaft 20. Pulp recirculation notches 22 may be provided in the flights 18 to permit the recirculation of the pulp.

The impeller 16 is mounted within the pump housing 24 and is rotated by the motor operated rotatable shaft 26. The pump housing 24 also has a pulp inlet 28 which is generally aligned with the screw feeder 15. The pulp inlet 28 receives the pulp from the screw feeder. A pulp outlet 30 extends along a plane generally transversely to the axis of the pulp inlet 28.

The pump impeller 16 receives the pulp from the screw feeder and impels the pulp generally radially outwardly toward the pulp outlet 30.

Figure 2:
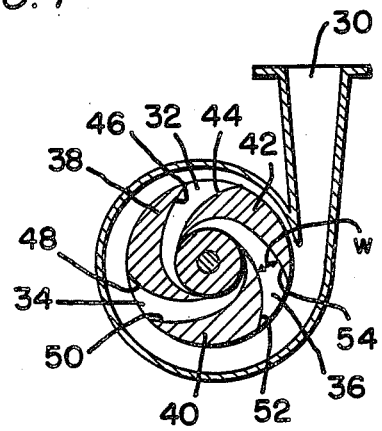
FIG. 2 is a view taken along lines 2—2 of FIG. 1 and in the direction of the arrows.

Referring to FIG. 2, the impeller 16 is provided with three channels 32, 34, and 36. The three channels are formed by the three vanes 38, 40, and 42. Channel 32 is formed by the side surface 44 of vane 42 and the side surface 46 of vane 38, channel 34 is formed by the side surface 48 of vane 38 and side surface 50 of vane 40, and channel 36 is formed by side surface 52 of vane 40 and the side surface 54 of vane 42. The channel bottom surfaces are formed by surfaces on the impeller extending radially with respect to the axis of the impeller. The three channels are located generally along the same plane which is transverse to the axis of the impeller. Thus the three channels extend substantially in the radial direction with respect to the axis of the impeller.

As can be seen from FIG. 1, the depth "d" of the channels is substantially the same throughout the radial length of the channels and as can be seen from FIG. 2, the width "w" differs very little along the length of the channel. Thus, each channel has substantially the same volume and each channel has a minimum of changes in the flow cross-section and a minimum of changes in the direction as the pulp flows through the channels.

The number of flow channels 32, 34, and 36 must be kept to a minimum to obtain the large cross-sectional dimensions of each flow channel to minimize friction. Also, the impeller can pass larger chunks of tramp material with large flow channels. Preferably, from two to four channels are used.

Figure 3:
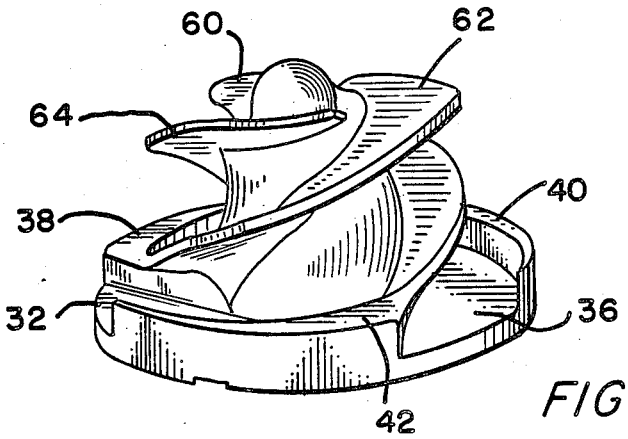
FIG. 3 is a side view of the pump impeller of FIGS. 1 and 2.
Figure 4:
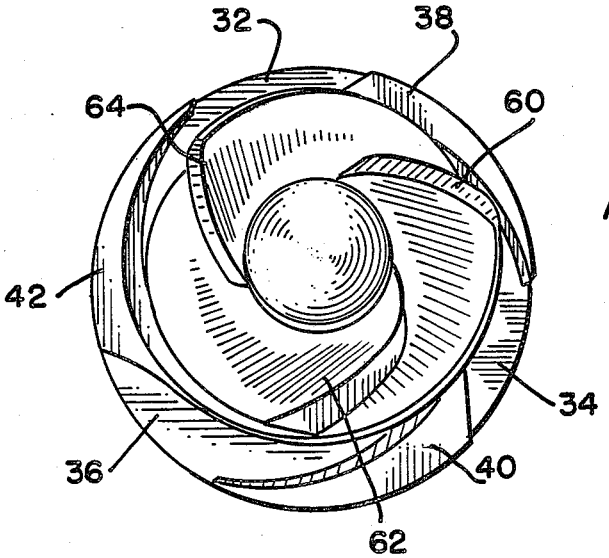
FIG. 4 is a front view of the pump impeller.

Referring to FIG. 3 and FIG. 4, the impeller is provided with three helical flights 60, 62, and 64 for feeding the pulp to the channels 32, 34 and 36, respectively. The helical flights are integral with and merge into the respective channel. One flight is used for each channel.

It is highly important that the space between the flights 60, 62, and 64 be sufficiently large so that the friction of the pulp against the flights will not cause the pulp to rotate with the impeller and stop the feeding of the pulp. As shown in FIG. 3 and FIG. 4, each flight 60, 62, and 64 extends around the impeller 16 slightly more than 180 degrees before the flights 60, 62, and 64 merge into the channels 32, 34, and 36, respectively.

The flights 60, 62, and 64 are not just a structure to prevent plugging of the pulp as is the case with prior art type pulp pumps. The flights also serve the very important additional function of force feeding, or pushing the pulp toward the radial channels 32, 34, and 36 of the impeller. This is especially important at start-up when no suction exists at the impeller inlet.

Air is never wanted in a pump, but is usually there. Often the air in the pump can be tolerated if it is intimately mixed and distributed throughout the pulp. However, sometimes due to process reasons it is necessary to remove the air.

By centrifugal action, pulp is separated from the air. A continually increasing radial space allows the centrifuged pulp to be recirculated by directing flow along the path shown by the solid arrows of FIG. 1.

Preferably, the radius of the annular member 75 which interconnects feeder housing 10 and pump housing 24 continuously decreases from feeder housing 10 to the pulp inlet 28. The flights 60, 62, and 64 of impeller 16 extend into the annular member 75. The radial space between the inside wall of annular member 75 and the flights 60, 62, and 64 continuously increases from pulp inlet 28 to the feeder housing 10.

In the embodiment of FIG. 1 through FIG. 4, air which is collected in pocket 71, is intimately mixed with the feed pulp and recirculating pulp flow. Intimately mixed air and feed pulp is then drawn through the impeller flights 60, 62, and 64 and the channels 32, 34, and 36. In order not to interfere with the intimate mixing of air in pocket 71 into the pulp, the end 73 of the pulp feeder screw flight 18 must be spaced a few inches away from the ends of the helical impeller flights. The length of the space separating the pulp feeder from the impeller must be sufficiently large to permit the formation of the pocket 71, but yet not so far away that the feeding of intimately mixed pulp and air mixture to the impeller is prevented. Preferably the separation ranges from three inches to six inches for intimately mixing air into the pulp. It is known that the separation of the end of the pulp feeder from the impeller 16 must be from three inches to six inches. Otherwise, the pump will not work without separate air removal means.

Figure 5:
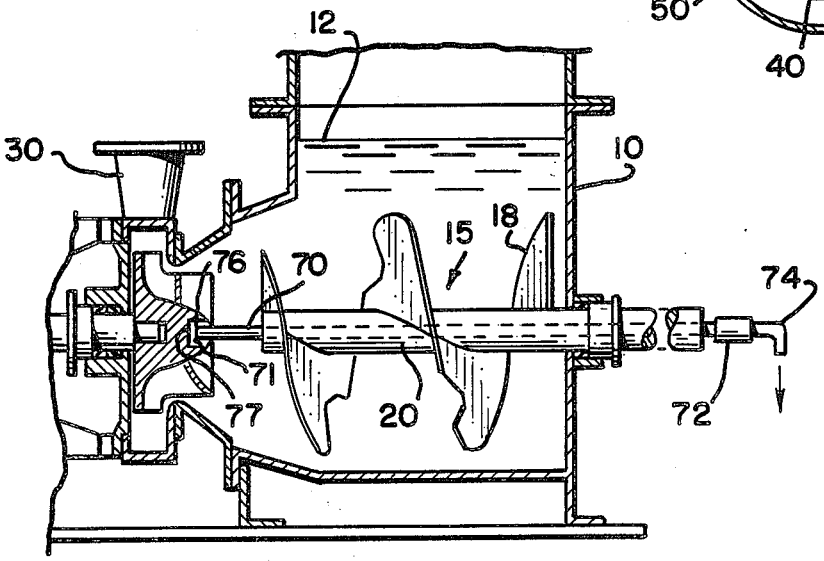
FIG. 5 is a fragmentary side view, partly in section, showing an embodiment of the invention which includes an air removal system.

A separate air removal system is shown in the embodiment of FIG. 5. To remove the air from the pocket 71, a tube 70 may be provided which extends through a bore along the axis of the shaft 20 of the feeder 15, through the rotary joint 72 and pipe 74 to a vacuum pump (not shown). The air removal entrance 76 of the tube 70 must extend axially into a recess 75 in the impeller end facing the pulp feeder 15. If desired, the entrance 76 may be substantially coincident with the end of shaft 20 of feeder 15 with the end of the flight 18 spaced from the end of shaft 20.

I claim:

1. Apparatus for pumping pulp comprising:

a pulp feeder housing;

a pulp feeder in the feeder housing;

a pump housing having a pulp inlet generally aligned with the pulp feeder for receiving the pulp from the pulp feeder, and a pulp outlet extending along a plane generally transverse to the axis of the pulp inlet;

an impeller in the pump housing for feeding the pulp from the pulp inlet to the pulp outlet;

said impeller having a predetermined number of channels, each formed by vanes and a channel bottom surface, said vanes and bottom surfaces being constructed to receive the pulp and pump the pulp to the pulp outlet, said channels extending substantially in a radial direction with respect to the axis of the impeller each channel having substantially the same volume, and each channel having minimum changes in flow cross-section and minimum changes in direction as the pulp flows through said channels; said impeller also having helical flights for feeding the pulp to the channels, one flight for each channel, there being a predetermined longitudinal space between the impeller and the pulp feeder.

2. An apparatus for pumping a pulp in accordance with claim 1 wherein the length of the longitudinal space between the impeller and the pulp feeder ranges from 3 inches to 6 inches.

3. An apparatus for pumping pulp in accordance with claim 1, wherein:

an annular member connects the feeder housing to the pump inlet; and the impeller has pulp feeding members extending into the annular member.

4. An apparatus for pumping pulp in accordance with claim 3, wherein:

the radius of the annular member continuously decreases from the feeder housing to the pump inlet.

5. Apparatus for pumping pulp in accordance with claim 1 wherein:

said impeller has an axially located recess facing the pulp feeder; and air removal means extending into said recess.

6. An apparatus for pumping pulp in accordance with claim 5 wherein: the plup feeder is a screw feeder having an axial bore; and the air removal means is a pipe in said bore and extending from said recess to outside the pulp feeder housing.

* * * * *